US007404683B2

(12) United States Patent
Mochizuki et al.

(10) Patent No.: US 7,404,683 B2
(45) Date of Patent: Jul. 29, 2008

(54) PRINTER

(75) Inventors: Yasufumi Mochizuki, Shizuoka (JP); Osamu Mizuno, Shizuoka (JP); Tadashi Nonaka, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 424 days.

(21) Appl. No.: 11/108,283

(22) Filed: Apr. 18, 2005

(65) Prior Publication Data

US 2005/0232678 A1 Oct. 20, 2005

(30) Foreign Application Priority Data

Apr. 20, 2004 (JP) ..... 2004-123697

(51) Int. Cl.
*B41J 15/00* (2006.01)
*B41J 15/04* (2006.01)

(52) U.S. Cl. ..... 400/613.1; 400/611; 400/613; 400/619; 400/693

(58) Field of Classification Search ..... 400/619, 400/88, 692, 693, 611, 613, 613.1; 242/570
See application file for complete search history.

(56) References Cited

U.S. PATENT DOCUMENTS 6,345,782 B1 * 2/2002 Nakayama et al. ..... 242/564.4
6,508,600 B1 * 1/2003 Nonaka ..... 400/621
6,607,316 B1 * 8/2003 Petteruti et al. ..... 400/82
6,609,844 B1 * 8/2003 Petteruti et al. ..... 400/88
6,987,523 B2 * 1/2006 Fujiwara ..... 347/218

FOREIGN PATENT DOCUMENTS

| | | |
|---|---|---|
| EP | 0 908 318 | 4/1999 |
| EP | 1 108 556 | 6/2001 |
| EP | 1 270 242 | 1/2003 |
| JP | 05-261985 | 10/1993 |

* cited by examiner

*Primary Examiner*—Daniel J. Colilla
*Assistant Examiner*—Kevin D Williams
(74) *Attorney, Agent, or Firm*—Pearne & Gordon LLP

(57) ABSTRACT

In a printer, when a cover is closed, a paper issuing path, and a paper setting path are formed downstream from a cutter mechanism in a paper transport path. The paths are switched over by a movable guide. During a normal printing process, the movable guide is swung by its own weight to close the paper setting path, and guides a paper to the paper issuing path. By contrast, during a process of setting paper, the movable guide is swung by the rigidity of the paper itself toward the paper issuing path, whereby the paper is prevented from being deformed with respect to the cutter mechanism.

2 Claims, 7 Drawing Sheets

20
26
80
81
81a
82
83
26a
26b
B
R
F
D

PRINTER

BACKGROUND OF THE INVENTION

1. Field of the Invention

The present invention relates to a printer in which a paper is pulled out from a roll paper, and which applies a printing process on the paper, cuts the paper, and issues the printed paper. The invention relates more particularly to a printer of a type which includes a printer body where the roll paper is to be accommodated, and a cover, and in which, when the roll paper is set, an excess paper end portion protruding from the boundary between the closed cover and the printer body is cut away, and the printed paper is then transported and issued through a paper discharge path that is different from a paper discharge path where the excess paper end portion exists.

2. Description of the Related Art

As a printer of this type, proposed is a printer in which, when a paper is set, an excess paper end portion protruding to the outside from the boundary between the closed cover and the printer body is cut away, a driving roller for the roll paper is then rotated in the direction opposite to the usual transporting direction to once pull back the paper end portion, and the driving roller is thereafter forward rotated to guide the paper end portion into a paper discharge path for issuance (see Japanese Patent No. 2,909,302 (Paragraphs 0007 to 0012, FIG. 2, etc.)).

SUMMARY OF THE INVENTION

In the printer disclosed in Japanese Patent No. 2,909,302, the driving roller must be reversely rotated, and the degree of the reverse rotation must be controlled so as to correspond to the distance of pulling back the paper end portion. Therefore, the structure is complicated and increased in size, and the production cost is correspondingly increased.

In the case where the paper discharge path is shortened in order to reduce the size of the printer, there arises a possibility in that, during a process of setting paper, the paper is forcedly deformed by a guide and this deformation causes wrinkles or a bend in the paper. In the case where an auto cutter for paper is disposed on the upstream side of the paper discharge path, when the paper is bent or skewed in the vicinity of the cutter, a cutting failure occurs to cause a trouble such as that the cutter is locked.

Therefore, it is an object of the invention to provide a printer which has different paper discharge paths respectively for a normal printing process and a process of setting paper, and in which paper can be prevented from being deformed in both the processes, and switching over of the paper discharge paths can be realized economically and surely by a simple configuration without using a driving system.

The printer of the invention includes: a printer body having a holding unit which rotatably holds a roll paper; a cover which is openably attached to the printer body; a paper transporting mechanism which pulls out a paper from the roll paper and transports the paper; a printing mechanism which applies a printing process on the paper transported by the paper transporting mechanism; a cutter mechanism which cuts the paper on which the printing process has been conducted by the printing mechanism; a first paper discharge path through which the paper on which the printing process has been conducted by the printing mechanism is transported; a second paper discharge path which is formed in a boundary between the cover and the printer body; and a movable guide which is movable between the first paper discharge path and the second paper discharge path, wherein the movable guide is urged toward the second paper discharge path by an own weight or an elastic member.

In the printer of the invention, when the cover is opened, the paper is pulled out from the roll paper held by the holding unit, and the cover is then closed, the pull-out paper extends in the second paper discharge path which is formed between the cutter mechanism, and the boundary between the cover and the printer body. An end portion of the paper which further extends from the cutter mechanism toward the tip end is an excess portion. The excess paper end portion is cut away by an operation of the cutter mechanism, and then pulled out to be removed away. During the process of setting paper, the movable guide is moved toward the first paper discharge path by the rigidity of the paper. When the paper end portion is cut away, the movable guide is returned by the own weight or the elastic member from the position to the second paper discharge path, or to a position where the paper is to be guided to the first paper discharge path. When a normal printing process is conducted in this state, the paper is guided to the first paper discharge path, and the paper which has been subjected to the printing and cutting processes are transported through the first paper discharge path to be stored in, for example, a paper stocker.

According to the invention, during the normal printing process, the movable guide is moved to the second paper discharge path, and therefore the paper is smoothly guided to the first paper discharge path. During the process of setting paper, when the paper extends in the second paper discharge path, the movable guide is moved to the first paper discharge path by the rigidity of the paper. Therefore, it is possible to prevent the paper from being forcedly deformed by the movable guide. As a result, the paper can be prevented from being deformed in both the normal printing process and the paper setting process. Since deformation of the paper is prevented as described above, the paper is held to a posture in which the paper is perpendicular or substantially perpendicular to the cutter mechanism, with the result that the cutting operation is stably conducted. The movement of the movable guide for switching over the paper discharge paths is conducted by the own weight of the movable guide itself or the elastic member. Therefore, a driving system for switching over is not required, so that the printer can be configured simply and economically.

According to the invention, the movable guide which switches over the paper path between the first paper discharge path and the second paper discharge path is urged toward the second paper discharge path. According to the configuration, during the normal printing process, the paper is guided to the first paper discharge path, and, during the process of setting paper, the paper extends in the second paper discharge path to cause the movable guide to be moved to the first paper discharge path. Therefore, the configuration attains effects that, in both the normal printing process and the process of setting paper, the paper can be prevented from being deformed, and that switching over of the paper discharge paths can be realized economically by the simple configuration without using a driving system.

DETAILED DESCRIPTION OF THE PREFFERED EMBODIMENTS

Hereinafter, an embodiment of the invention will be described with reference to the accompanying drawings.

Figure 1:
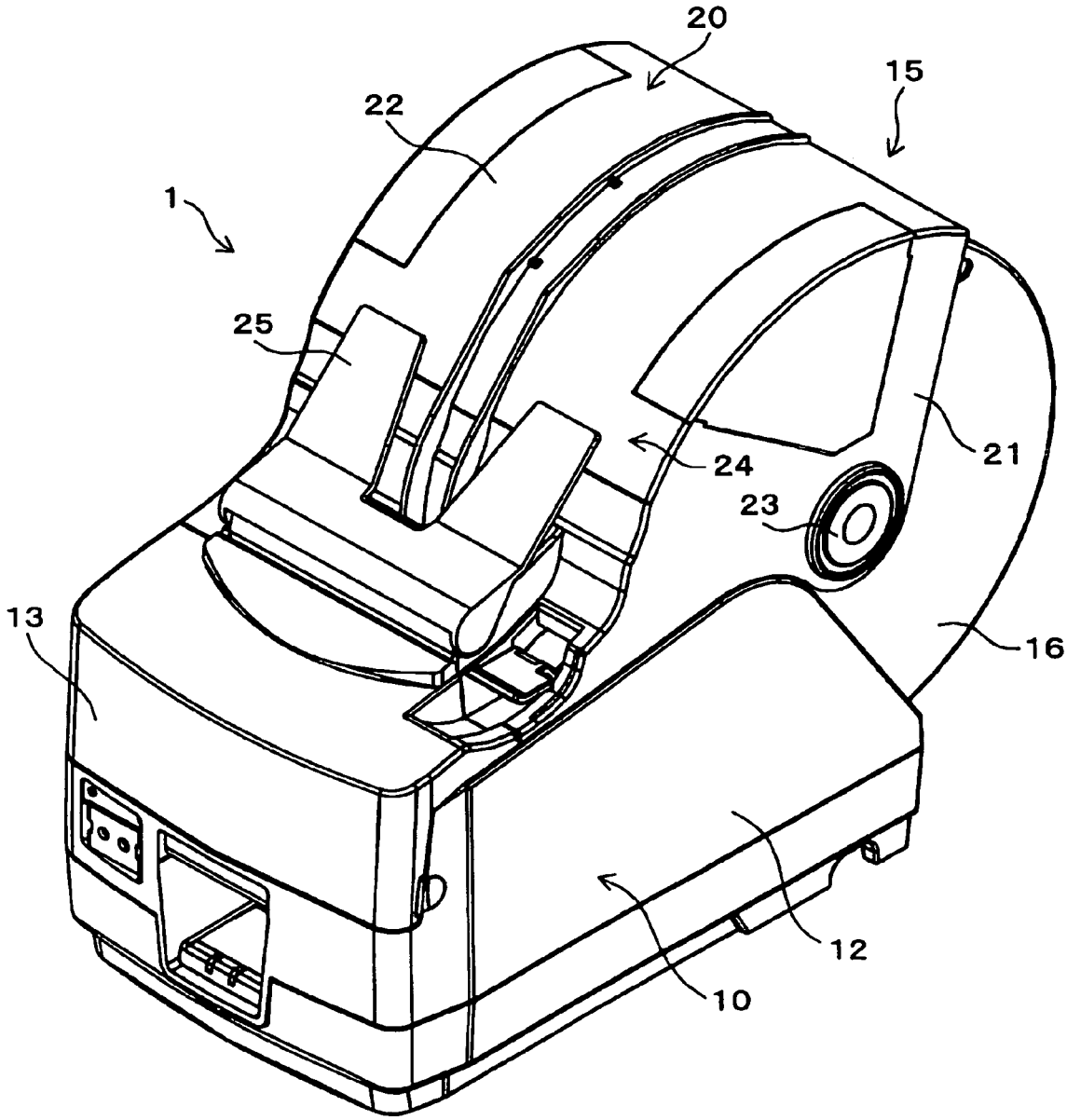
FIG. 1 is a perspective view showing a state where a cover of a printer of an embodiment of the invention is closed.
Figure 2:
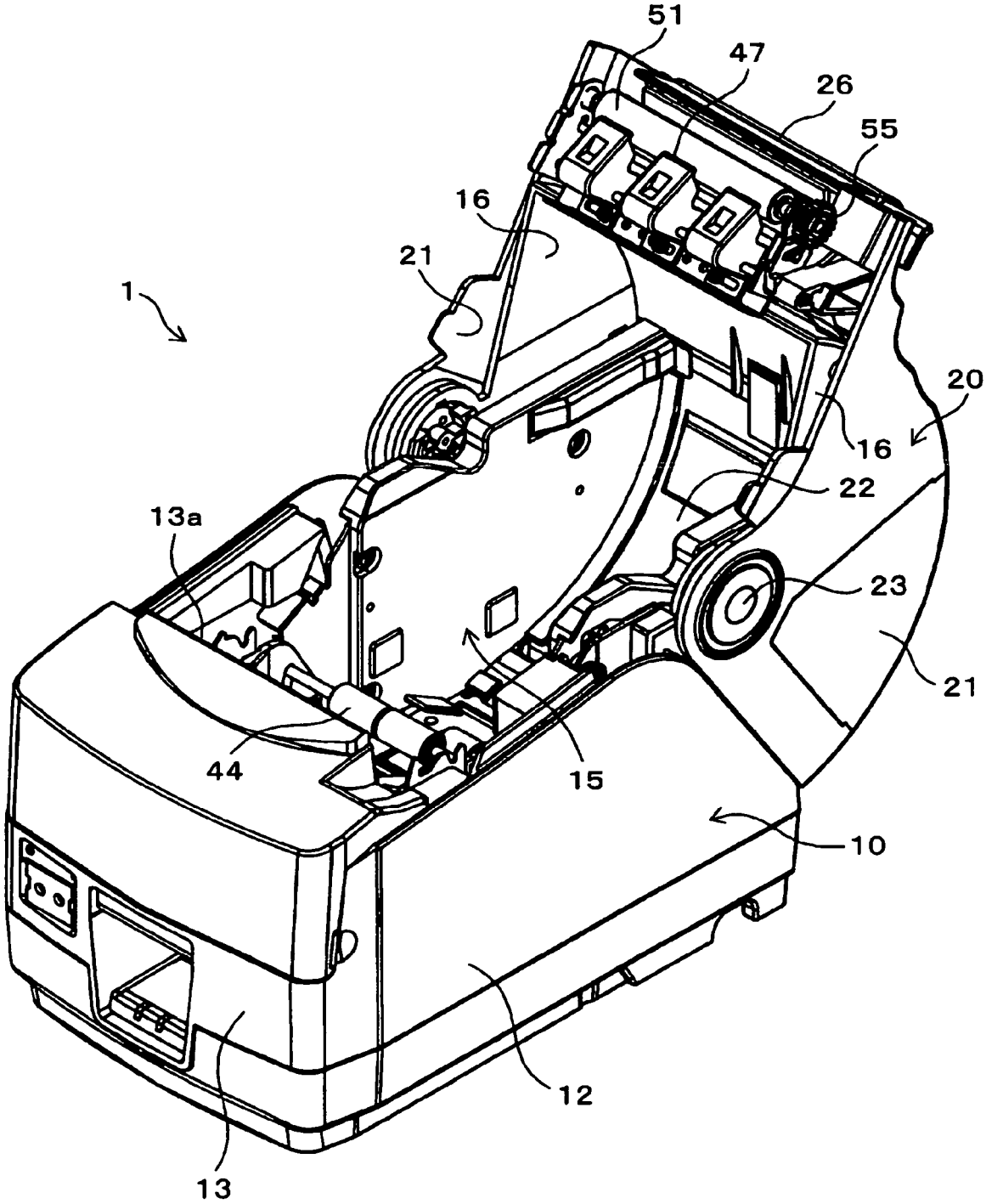
FIG. 2 is a perspective view showing a state where the cover of the printer of the embodiment is opened.
Figure 3:
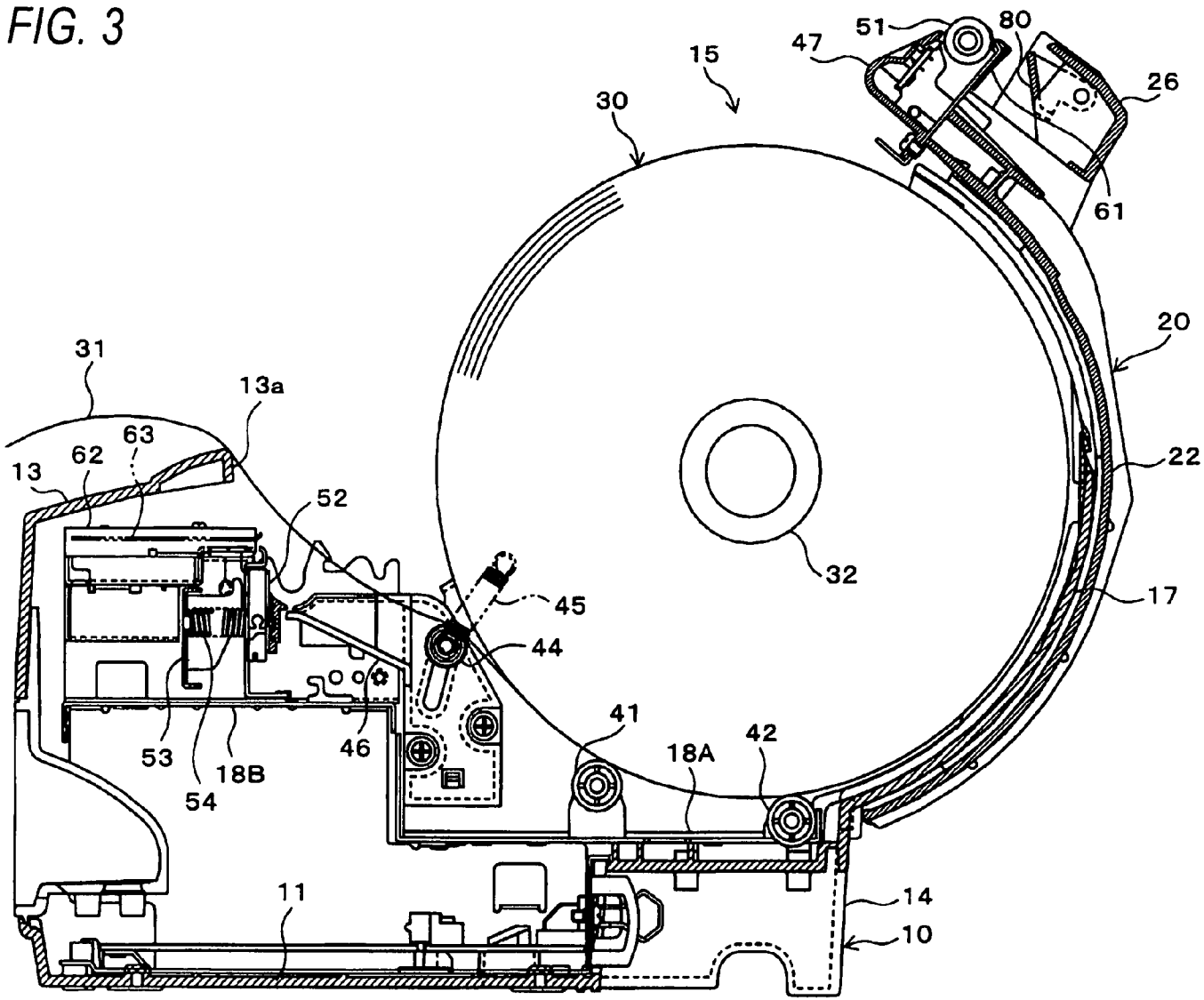
FIG. 3 is a side sectional view of the printer of the embodiment showing a first stage of a paper setting process in which the cover is opened and a paper is pulled out from a roll paper.
Figure 4:
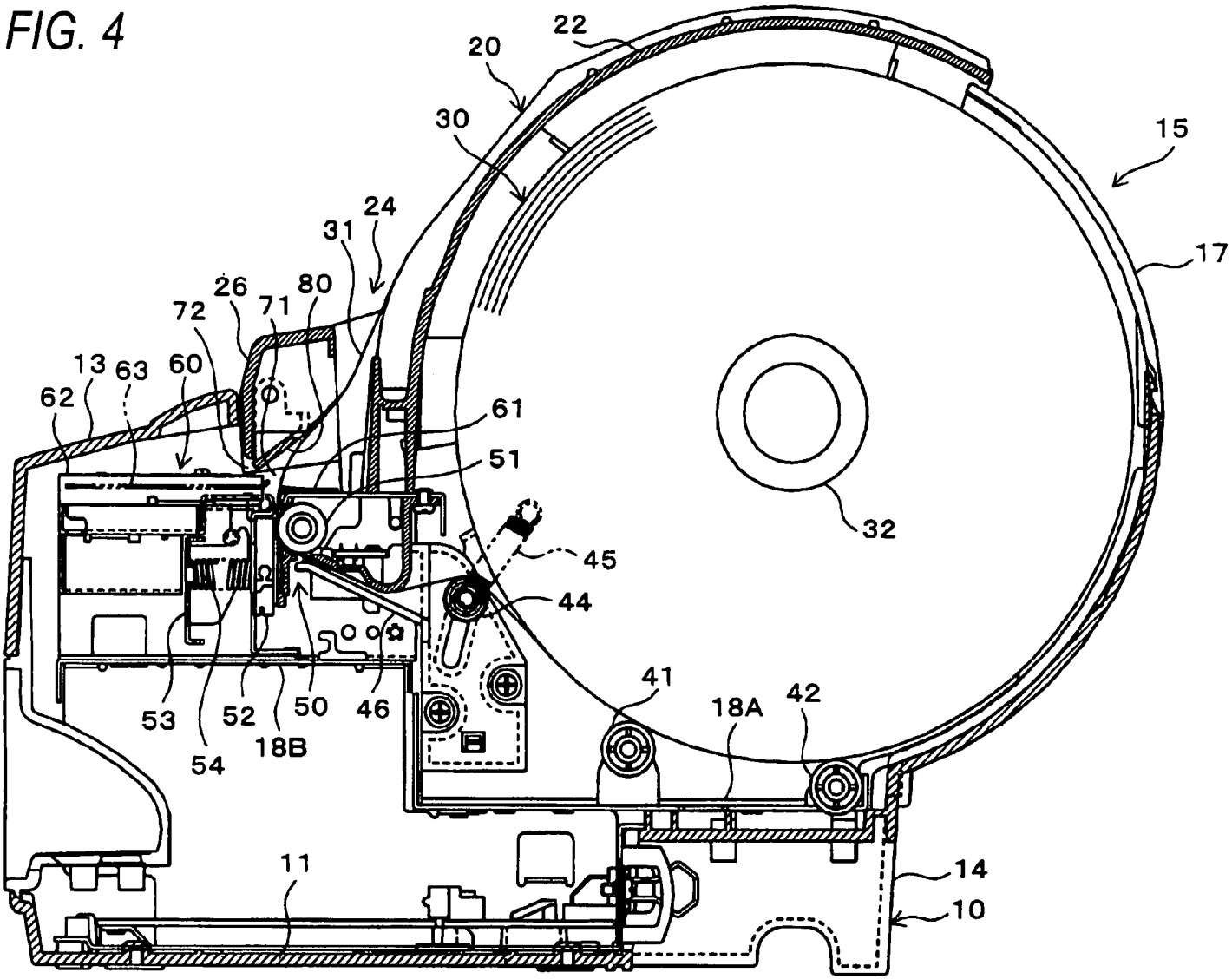
FIG. 4 is a side sectional view of the printer of the embodiment showing a second stage of the paper setting process in which the cover is closed.
Figure 5:
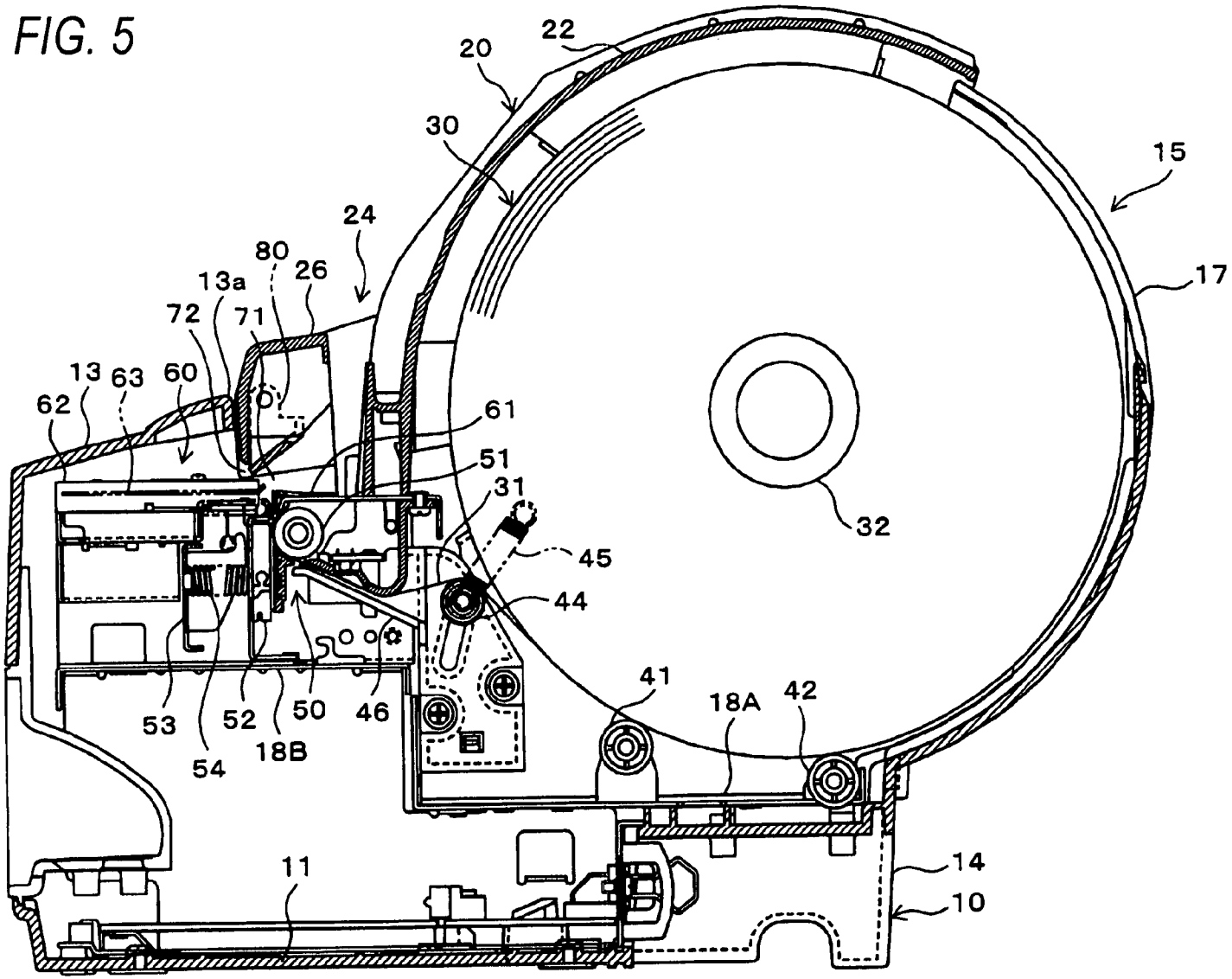
FIG. 5 is a side sectional view of the printer of the embodiment showing a state where the paper setting process is completed and the normal printing process is waited.
Figure 6:
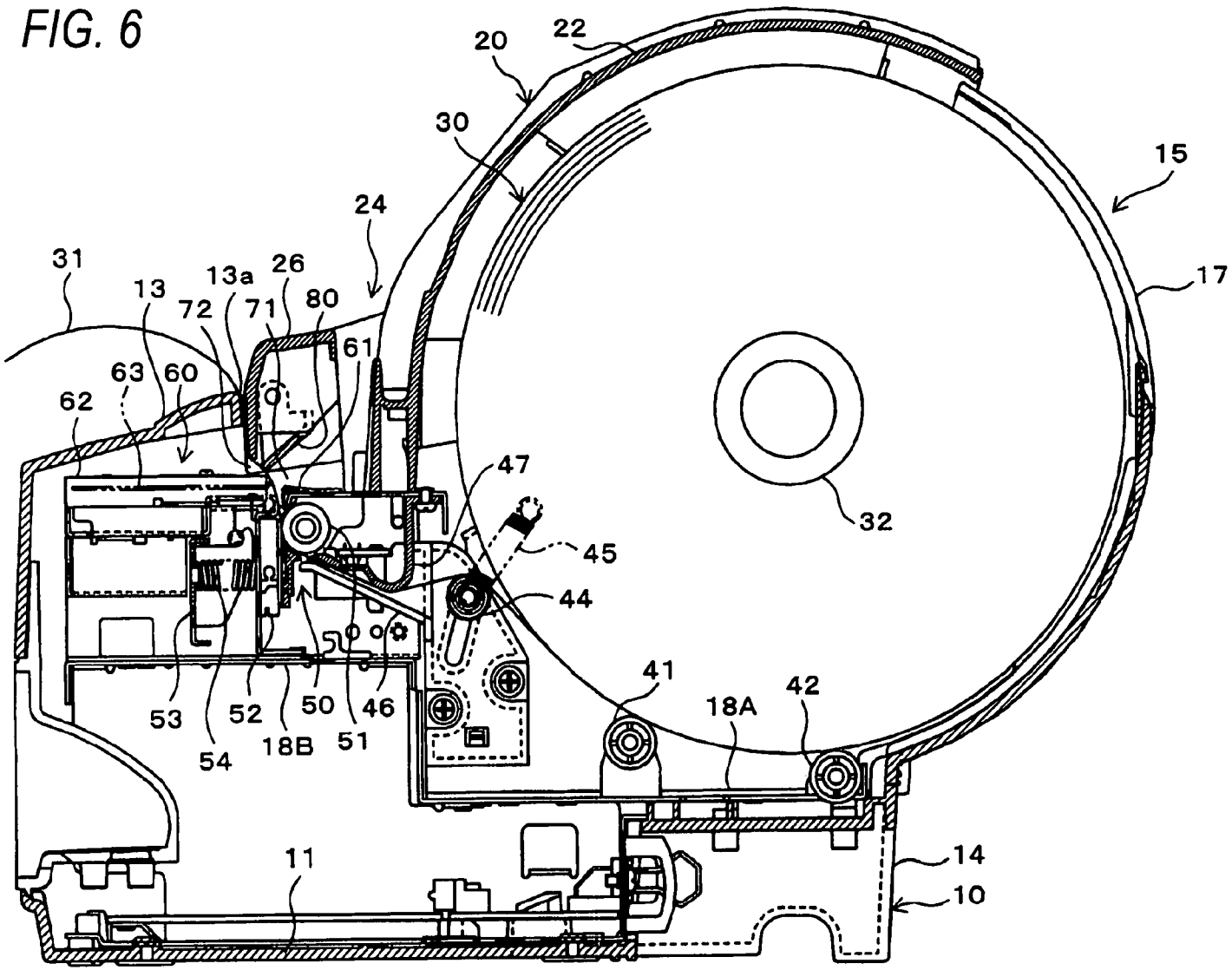
FIG. 6 is a side sectional view of the printer of the embodiment showing a state where printing and transportation are being conducted on the paper.

FIG. 1 shows a small printer which is preferably used in an electronic cash register or the like. In the printer 1, the external shape is formed by a printer body 10, and a cover 20 which is openably attached to the printer body 10. FIG. 1 is a perspective view showing a state where the cover 20 is closed, and FIG. 2 is a perspective view showing a state where the cover 20 is opened. FIG. 3 is a side sectional view showing the state where the cover 20 is opened, and FIGS. 4 to 6 are side sectional views showing the state where the cover 20 is closed.

As shown in FIGS. 1 to 6, the printer body 10 has a box-like shape including a bottom plate 11, a pair of right and left side plates 12, a front plate 13, and a back plate 14. A roll paper holder unit (holding unit) 15 which has a substantially semicylindrical shape is formed in rear of the case. The roll paper holder unit 15 is of the drop-in type in which a roll paper 30 is dropped to be loaded, and formed by: right and left rear plates 16 each of which has a sector shape, and which are formed in rear of the side plates 12 (the rear side in FIGS. 1 and 2, and the right side in FIGS. 3 to 6); and a curved plate 17 which connects together arcuate peripheral edges of the rear plates 16. As shown in FIG. 3, the roll paper 30 in which a paper 31 is stored with being wound around a core member 32 is dropped and loaded into the roll paper holder unit 15 in a posture in which the axial direction of the core member 32 is parallel to the lateral direction, a leading portion of the paper 31 is to be pulled out from the lower side toward the front side (the front side in FIGS. 1 and 2, and the left side in FIGS. 3 to 6).

As shown in FIGS. 3 to 6, a frame 18A is fixed to a bottom portion of the roll paper holder unit 15, and two rollers 41, 42 in which the axes elongate in the lateral direction are rotatably supported on the frame 18A. The rollers 41, 42 are longitudinally arranged at an adequate interval. The roll paper 30 is placed on the rollers 41, 42 so as to be axially rotatable. When the paper 31 is forward pulled out, the roll paper 30 is rotated, and also the rollers 41, 42 are rotated in accordance with the rotation. Namely, the rollers 41, 42 enable the roll paper 30 to be smoothly rotated.

As shown in FIGS. 1 to 6, the cover 20 is formed into a substantially semicylindrical shape which is similar to the roll paper holder unit 15, and which is slightly larger than the roll paper holder unit 15. The cover is mounted so as to, in an opened state, cover the outer side of the roll paper holder unit 15. Specifically, the cover 20 includes: a pair of right and left side plates 21 each having a substantially sector shape; and a curved plate 22 which connects together arcuate peripheral edges of the side plates 21. In each of the side plates 21, a portion corresponding to the axis of the curved plate 22 is supported via a cover shaft 23 swingably and coaxially with the axis of the curved plate 17 of the roll paper holder unit 15.

When the cover 20 is rearward swung, the cover 20 is opened along the outer side of the roll paper holder unit 15, so that, as shown in FIGS. 2 and 3, an opening of the printer body 10 (this opening is formed mainly by an opening of the roll paper holder unit 15) is opened. When the cover 20 in this state is swung to the front side, the opening of the printer body 10 is closed as shown in FIGS. 1 and 3 to 6. In a state where the cover 20 is fully closed, the roll paper holder unit 15 and the cover 20 cooperate so as to form a rear portion of the printer 1 into a cylindrical shape. The fully closed state of the cover 20 is maintained by an engaging and disengaging member which is not shown.

As shown in FIGS. 4 to 6, the printer 1 includes: a printing mechanism 50 which conducts a printing process on the paper 31 that is pulled out from the roll paper 30; and a press-cutting type cutter mechanism 60 which cuts the paper 31 that has been subjected to the printing process. The printing mechanism 50 is configured by: a platen roller 51 which is attached to a tip end portion of the cover 20 serving as a rotational end portion; and a thermal print head 52 which is attached to a frame 18B fixed to a front portion in the printer body 10. The print head 52 is always urged toward the platen roller 51 by a coil spring 54 which is attached to a spring frame 53.

When the cover 20 is closed, the platen roller 51 is opposed to the print head 52, and the print head 52 is elastically brought into press contact with the platen roller 51 by the elasticity of the coil spring 54. The paper 31 pulled out from the roll paper 30 is interposed between the platen roller 51 and the print head 52, and then further pulled out by rotation of the platen roller 51. When the paper 31 is pulled out, the roll paper 30 is rotated. Namely, the printing mechanism 50 functions also as a paper transporting mechanism which pulls out the paper 31 from the roll paper 30, and transports the paper.

As shown in FIG. 2, a driven gear 55 is coaxially fixed to one end portion of the shaft of the platen roller 51. When the cover 20 is fully closed, the driven gear 55 meshes with a reduction gear which is incorporated in the printer body 10 to be driven by a transportation motor (both the reduction gear and the motor are not shown). When the transportation motor operates in this state, the platen roller 51 is rotated in the transport direction of the paper 31 (clockwise in FIGS. 3 to 6). In the following description, the terms of upstream and downstream mean the directions in a transport path for the paper 31, respectively.

The cutter mechanism 60 is disposed immediately downstream (the upper side in FIGS. 3 to 6) from the printing mechanism 50, and configured by: a stationary blade 61 which is fixed to the tip end portion of the cover 20; and a movable blade unit 62 which is fixed to the frame 18B in the printer body 10. The movable blade unit 62 includes a movable blade 63 which is driven so as to longitudinally reciprocate. When the cover 20 is closed, the stationary blade 61 is opposed to the movable blade 63 across a gap through which the paper 31 can pass. When the movable blade 63 is rearward moved, the blade edge slides over the upper face of the stationary blade 61 while being pressingly contacted therewith. As a result of this operation, the paper 31 interposed between the blades 61, 63 is cut.

A pair of guide plates 46, 47 which guide the paper 31 to the printing mechanism 50 are disposed upstream from the printing mechanism 50. The one guide plate 46 is disposed on the printer body 10, and the other guide plate 47 on the tip end portion of the cover 20. In a state where the cover 20 is closed, the paper transport path which is narrow, and which guides a leading portion of the paper 31 toward the printing mechanism 50 is formed between the guide plates 46, 47. A tension roller 44 which pushes up the paper 31 to apply tension to the paper is disposed upstream from the guide plate 46 on the side of the printer body 10. The tension roller 44 is upward urged by a plate spring 45 disposed on the printer body 10.

As shown in FIGS. 1 and 4 to 6, a paper stocker 24 is formed on the outer circumferential face of the tip end portion of the cover 20. Paper sheets each of which has been subjected to the printing process by the printing mechanism 50 and then cut away by the cutter mechanism 60 are sequentially over lappingly stored on the stocker so as to extend along the curved plate 22 of the cover 20. The paper sheets stored on the paper stocker 24 are held by a presser plate 25 shown in FIG. 1.

In the printer 1, in the state where the cover 20 is closed, as shown in FIGS. 4 to 6, a paper issuing path (first paper discharge path) 71 through which the paper 31 on which the printing process has been conducted is to be transported to the paper stocker 24, and a paper setting path (second paper discharge path) 72 which reaches the boundary between the printer body 10 and the cover 20 are formed downstream from the cutter mechanism 60. During the normal printing process, the paper 31 on which the printing process has been conducted by the printing mechanism 50 passes through the paper issuing path 71, advances to the paper stocker 24, and is then cut by the cutter mechanism 60 to be stored on the paper stocker 24. The paper issuing path 71 is formed in the cover 20.

By contrast, during the process of setting paper, i.e., when, in the state where the cover 20 is opened, an end portion of the paper 31 is forward pulled out from the roll paper 30 loaded in the roll paper holder unit 15 to the outside of the printer body 10, and the cover 20 is then closed, the end portion of the pulled-out paper 31 extends in the paper setting path 72. The paper setting path 72 is a gap which vertically extends, and which is formed between an opening edge 13*a* of the front plate 13 of the printer body 10, and the front face of a tip end cover portion 26 which is formed in a tip end portion of the cover 20, and which has an L-like sectional shape.

Figure 7:
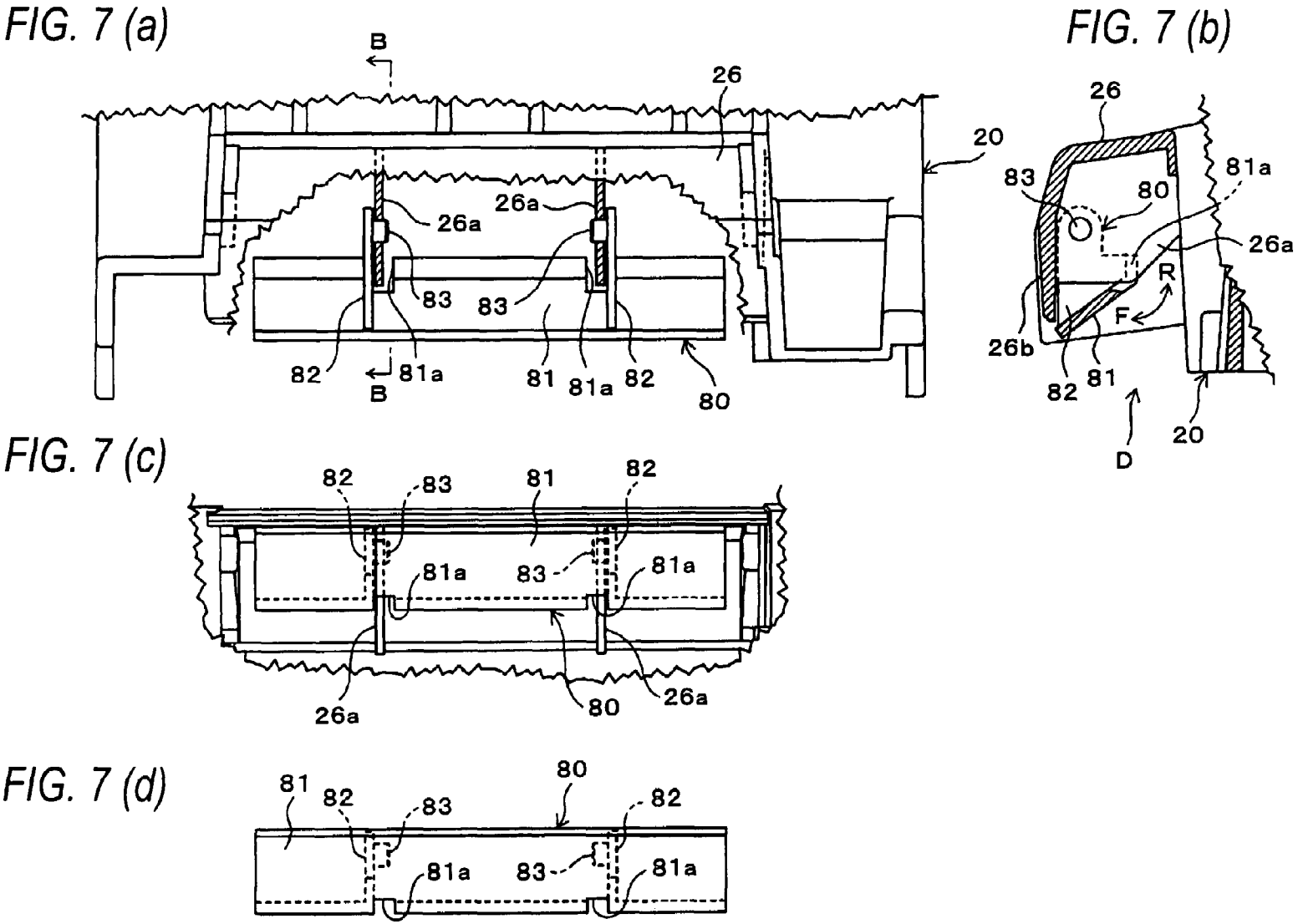
FIGS. 7(*a*) to 7(*c*) are views showing a structure for attaching a movable guide in the embodiment, in which FIG. 7(*a*) is a plan view, FIG. 7(*b*) is a sectional view taken along the line B-B in FIG. 7(*a*), FIG. 7(*c*) is a rear view, and FIG. 7(*d*) is a view of the movable guide as seen in the direction of D in FIG. 7(*b*)

A movable guide 80 which, during the normal printing process, guides the paper 31 to the paper issuing path 71 is disposed in the tip end cover portion 26. As shown in FIGS. 7(*a*) to 7(*d*), the movable guide 80 includes: a guide plate portion 81 which, in the state where the cover 20 is closed, is inclined rearward and upward (rightward and upward in FIG. 7(*b*)); and a pair of right and left support plate portions 82 which upward extend from the guide plate portion 81.

In the movable guide 80, the support plate portions 82 are attached so as to be swingable in the directions of the arrows F and R in FIG. 7(*b*), via pins 83 and ribs 26*a* formed on the inner side of the tip end cover portion 26. In the guide plate portion 81, slits 81*a* into which the ribs 26*a* partly enter are formed to enable the movable guide 80 to swing. The movable guide 80 swings in the range from a state where the support plate portions 82 butt against a front plate portion 26*b* of the tip end cover portion 26, to that where the innermost portions of the slits 81*a* butt against the ribs 26*a*. In the state where the cover 20 is fully opened, as shown in FIG. 3, the movable guide 80 is swung by its own weight in the counterclockwise direction in the figure (the direction of the arrow R in FIG. 7(*b*)), and the innermost portions of the slits 81*a* butt against the ribs 26*a*, respectively.

When the cover 20 is closed, as shown in FIGS. 5 and 6, the movable guide 80 is swung by its own weight in the clockwise direction in the figure (the direction of the arrow F in FIG. 7(*b*)), and the state where the support plate portions 82 butt against the front plate portion 26*b* is maintained. At this time, the guide plate portion 81 of the movable guide 80 is positioned immediately downstream from the cutter mechanism 60, i.e., directly above the gap between the stationary blade 61 and the movable blade 63. As a result, the paper setting path 72 is closed, and the tip end of the paper which is raised after passing through the cutter mechanism 60 butts against the guide plate portion 81 to be guided to the paper issuing path 71 which is in the right side of FIG. 6.

By contrast, when the paper 31 which is continuous to the roll paper 30 extends in the paper setting path 72, the paper 31 is to be set to a printable state. The process of setting the paper is conducted in the following manner. As shown in FIG. 3, the cover 20 is opened, and the roll paper 30 is loaded into the roll paper holder unit 15. Then, an end portion of the paper 31 is forward pulled out from the roll paper 30 loaded in the roll paper holder unit 15 to the outside of the printer body 10, and the cover 20 is thereafter closed. As a result, as shown in FIG. 4, the paper 31 is interposed between the guide plates 46, 47, between the platen roller 51 and the print head 52, between the stationary blade 61 and the movable blade 63, and between the opening edge 13*a* of the printer body 10 and the tip end cover portion 26 of the cover 20 in this sequence as viewed from the upstream side. At this time, the paper 31 which is downstream from the cutter mechanism 60 (this portion of the paper is an excess end portion to be removed away) butts against a lower end portion of the movable guide 80 and extends in the paper setting path 72 which is on the left side of the movable guide 80. The movable guide 80 is pushed by the paper 31 which butts there against, to be swung counterclockwise in FIG. 4.

A method of using the printer 1 and operations of the printer will be described. The paper transporting and printing operations are automatically conducted by a control unit which is disposed in, for example, the printer body 10.

First, as shown in FIG. 3, the user opens the cover 20, and pulls out a leading portion of the paper 31 from the roll paper 30 loaded in the roll paper holder unit 15, to the outside of the printer head 10, and then closes the cover 20. As a result, the end portion of the paper 31 extends in the paper setting path 72 which is on the left side of the roll paper 30. At this time, the movable guide 80 which is originally located at the position where the guide is clockwise swung at the largest degree by the own weight ("issuance guiding position" where the paper 31 is guided to the paper issuing path 71) is swung counterclockwise by the rigidity (stiffness) of the paper 31 which butts against the guide simultaneously with the closing of the cover 20, and then held to "paper setting position".

In the case where the movable guide 80 is set to the paper setting position, the degree of bending in the portion from the cutter mechanism 60 to the movable guide 80 is smaller than that in the case where the movable guide 80 is at the issuance guiding position. Therefore, the bent condition of the paper 31 in the vicinity of the cutter mechanism 60 during the paper setting process can be relaxed.

Next, the cutter mechanism 60 operates so that the movable blade 63 of the movable blade unit 62 reciprocates to cut the leading portion of the paper 31 extending in the paper setting path 72. As a result, the pressing operation due to the paper 31 is eliminated. Therefore, the movable guide 80 is swung by the own weight in the clockwise direction in FIG. 5 to the issuance guiding position, and the printer then enters a waiting state for the normal printing process shown in FIG. 5. The excess end portion of the paper 31 which has been cut away is interposed between the opening edge 13*a* of the printer body

10 and the front plate portion 26*b* of the tip end cover portion 26, and can be pulled out to the outside to be removed away.

The normal printing process is started by supplying a printing command to the print head 52 and the transportation motor. Specifically, the printing process is conducted by repeating a printing operation by the print head 52, and an operation of transporting the paper 31 by rotation of the platen roller 51. The transported paper 31 butts against the guide plate portion 81 of the movable guide 80 to be guided to the paper issuing path 71, and then transported to the paper stocker 24.

When the printing process is ended, the platen roller 51 is rotated by a degree corresponding to a predetermined length to transport the paper 31 so as not to cut a printed portion. Thereafter, the cutter mechanism 60 operates to cut the paper 31. The cut paper 31 is stored on the paper stocker 24.

In the printer 1, during the process of setting paper, the movable guide 80 is swung by the rigidity of the paper 31 toward the paper issuing path 71, i.e., in the direction along which the guide is separated from the paper setting path 72. Therefore, the degree of bending in the portion of the paper setting path 72 in the range from the cutter mechanism 60 to the movable guide 80 is relaxed as described above. Therefore, the posture of the paper 31 can be held perpendicular or substantially perpendicular to the cutter mechanism 60, with the result that the cutting operation is stably conducted during the paper setting process, and a failure such as that the cutter mechanism 60 is locked is prevented from occurring.

During the normal printing process, the movable guide 80 is moved by its own weight to the issuance guiding position, i.e., toward the paper setting path 72. Therefore, the transported paper 31 is smoothly guided by the movable guide 80 from the paper issuing path 71 to the paper stocker. As a result, paper can be prevented from being deformed in both the normal printing process and the paper setting process. Moreover, the movable guide 80 is returned by the own weight to the issuance position. Therefore, a driving system for switching over the paths is not required, so that the printer can be configured simply and economically.

In the embodiment, the movable guide 80 is swung by the own weight. In place of the above, the movable guide 80 may be configured so as to be swung by an elastic member such as a spring.

What is claimed is:

1. A printer comprising:

a printer body having a holding unit which rotatably holds a roll paper;

a cover which is openably attached to the printer body;

a paper transporting mechanism which pulls out a paper from the paper roll and transports the paper;

a printing mechanism which applies a printing process on the paper transported by the paper transporting mechanism;

a cutter mechanism which cuts the paper on which the printing process has been conducted by the printing mechanism;

a first paper discharge path through which the paper on which the printing process has been conducted by the printing mechanism is transported;

a second paper discharge path which is formed in a boundary between the cover and the printer body; and a movable guide which is movable between the first paper discharge path and the second paper discharge path, the movable guide being urged toward the second paper discharge path by an own weight or an elastic member, wherein the movable guide positions toward the first paper discharge path when the cover is closed after the paper is pulled out from the roll paper and placed on the second paper discharge path, and wherein the movable guide rotatably moves from the first paper discharge path toward the second paper discharge path as a result of the paper being cut by the cutter mechanism, to thereby guide the paper applied with the printing process toward the first paper discharge path.

2. A printer according to claim 1, wherein the second paper discharge path has a curved portion between the cutter mechanism and the movable guide, the curved portion having a first curvature when the movable guide is moved toward the second paper discharge path and having a second curvature that is more loose than the first curvature when the movable guide is moved toward the first paper discharge path.

* * * * *